US006535094B2

(12) United States Patent
Murata et al.

(10) Patent No.: US 6,535,094 B2
(45) Date of Patent: Mar. 18, 2003

(54) MULTILAYER INDUCTOR

(75) Inventors: Satoshi Murata, Yokaichi (JP); Hideyuki Mihara, Shiga-ken (JP); Etsuji Yamamoto, Yokaichi (JP); Yoshihiro Nishinaga, Hikone (JP); Minoru Tamada, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/808,668

(22) Filed: Mar. 15, 2001

(65) Prior Publication Data

US 2001/0033218 A1 Oct. 25, 2001

(30) Foreign Application Priority Data

Mar. 15, 2000 (JP) ..... 2000-072181

(51) Int. Cl.[7] ..... H01F 27/02
(52) U.S. Cl. ..... 336/83; 336/200; 336/206
(58) Field of Search ..... 331/65, 83, 198, 331/192, 200, 208, 207, 206, 232; 29/602.1, 605, 606

(56) References Cited

U.S. PATENT DOCUMENTS 4,733,213 A * 3/1988 Graul ..... 336/206
5,906,768 A * 5/1999 Kakinuma et al. ..... 336/233
6,073,339 A * 6/2000 Levin ..... 336/200

FOREIGN PATENT DOCUMENTS

| | | |
|---|---|---|
| JP | 63-51609 | * 3/1988 |
| JP | 2-256214 | * 10/1990 |
| JP | 5-41324 | 2/1993 |
| JP | 5-299250 | * 11/1993 |

* cited by examiner

*Primary Examiner*—Elvin Enad
*Assistant Examiner*—Tuyen T. Nguyen
(74) *Attorney, Agent, or Firm*—Keating & Bennett, LLP

(57) ABSTRACT

Three thin-film coils having insulating layers therebetween are laminated on the coil winding portion of the core member. A terminal electrode is electrically connected to the end portion of the third thin-film coil. A terminal electrode is electrically connected to the end portion of the first thin-film coil through the lead-out opening portions and separated areas. In this way, the thin-film coils are electrically connected in series between the terminal electrodes. Then, in the thin-film coils, the winding directions of the neighboring coils having an insulating layer therebetween are opposite to each other.

10 Claims, 11 Drawing Sheets

MULTILAYER INDUCTOR

BACKGROUND OF THE INVENTION

1. Field of the Invention

The present invention relates to a surface-mount type multilayer inductor used as multilayer inductors, particularly as choke coils, LC filters, and other suitable inductors.

2. Description of the Related Art

A conventional inductor is disclosed in Japanese Unexamined Patent Application Publication No. 5-41324. The inductor is provided with a columnar magnetic core made of an insulating magnetic material such as ferrite. A conductor film is provided on the surface of the magnetic core, and then, the conductor film is irradiated with a laser beam and the laser beam moves in an axial direction while the magnetic core is rotated, a spiral coil-forming groove is formed and a coil spirally surrounding the magnetic core is defined by the remaining portion of the conductor film. In this way, a conventional inductor is made of a one-layer coil.

In the conventional inductors, such means as 1) using a magnetic core having a large sectional area, 2) increasing the number of turns of the coil, and 3) using a magnetic material having a high magnetic permeability as a magnetic core material are generally employed to increase inductance. However, the magnetic permeability of the magnetic cores and their dimensions (sectional area, length) are restricted and it is difficult to obtain the desired inductance. Moreover, when the number of turns of the coil is increased by reducing the width of a coil conductor to obtain the desired inductance, the DC resistance of the coil increases, and further the Q value of the coil decreases.

SUMMARY OF THE INVENTION

To overcome the above-described problems with the prior art, preferred embodiments of the present invention provide a compact multilayer inductor in which a high inductance is achieved.

A multilayer inductor according to the present invention includes a core member, a plurality of thin-film coils spirally wound and laminated on the surface of the core member, and terminal electrodes provided at the individual end portions of the core member, wherein the winding directions of the adjacent thin-film coils, having insulating layers therebetween, are opposite to each other, and wherein the plurality of the thin-film coils are electrically connected in series.

Preferred embodiments of the present invention provide separating portions for electrically connecting the thin-film coils in series, the separating portions arranged between an area where the thin-film coils are provided and the areas where the terminal electrodes are provided to surround the periphery of the core member, wherein the adjacent thin-film coils having the insulating layers therebetween are electrically connected in series through an opening portion for connecting the thin-film coils provided in the insulating layers.

The core member is, for example, dumbbell-shaped. Further, preferred embodiments of the present invention provide an identification portion for identifying the direction of the core member on at least one of an end face and a side face of the core member. Furthermore, at least one of the beginning portion and the end portion of a coil including the plurality of thin-film coils electrically connected in series is electrically connected to the terminal electrode through lead-out opening portions provided in the insulating layers.

When constructed as described above, the winding directions of the adjacent thin-film coils, having insulating layers therebetween, are opposite to each other, each individual thin-film coil of the plurality of thin-film coils generates a magnetic field in the same direction and the coils define one coil. In this way, the length of the core member is greatly decreased and the number of turns of the thin-film coils is increased as compared with an inductor where the plurality of thin-film coils is arranged side by side in the axial direction of the core member. Moreover, because a plurality of thin-film coils, having insulating layers therebetween, is arranged on the core member having a common axis, distributed capacitance is produced uniformly between the thin-film coils.

Moreover, the multilayer inductor according to the present invention includes second separating portions for forming separated areas electrically disconnected from the thin-film coils below the terminal electrodes, the second separating portions arranged between the area where the thin-film coils are provided and the areas where the terminal electrodes are provided to surround the periphery of the core member.

Based on the above construction, as the separated areas and the coil are electrically disconnected, even if layers are short-circuited below the terminal electrodes, a portion of the coils is not short-circuited and accordingly the coil construction is not adversely affected.

Other features, elements, characteristics and advantages of the present invention will become apparent from the detailed description of preferred embodiments thereof with reference to the attached drawings.

DETAILED DESCRIPTION OF PREFERRED EMBODIMENTS

Hereinafter, the preferred embodiments of a multilayer inductor according to the present invention will be described together with the manufacturing method thereof with reference to the accompanying drawings.

Figure 1:
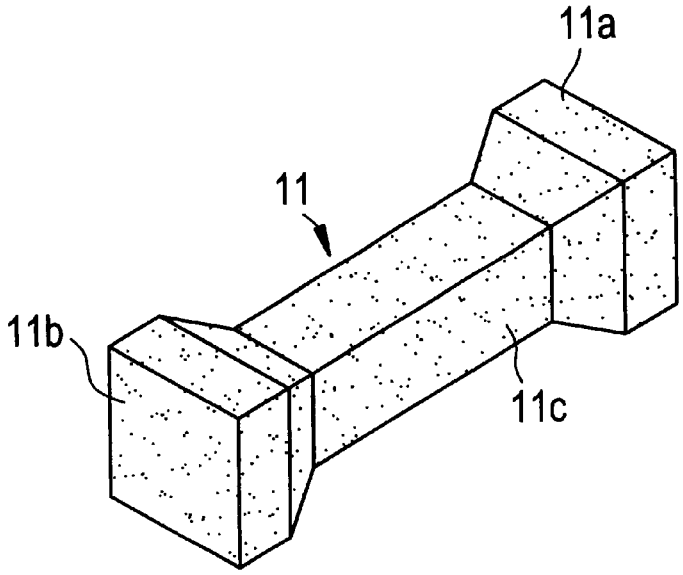
FIG. 1 is a perspective view showing a manufacturing step of a multilayer inductor according to a first preferred embodiment of the present invention.

FIG. 1 illustrates a first preferred embodiment of the present invention including a core member 11 having a dumbbell shape which is composed of a coil winding portion 11*c* having a rectangular crosssection and square crosssection and flange portions 11*a* and 11*b* provided at both ends of the coil winding portion 11*c*. The core member 11 is made of a magnetic material such as Ni—Zn—Cu ferrite, or other suitable magnetic material, a ceramic material such as nonmagnetic alumina, a resin material, or other suitable material. By heat-treatment, while agitating, of the core member 11 and zinc-borosilicate system glass powder at 800 to 900° C., the glass powder is deposited on the surface of the core member 11 to form an insulating coating film 3 (see FIG. 7). As is described later, this insulating coating film 3 prevents the magnetic reluctance of the core member 11 from decreasing, due to deterioration of the core member 11 by a laser beam reaching the core member 11 when a thin-film coil is formed by irradiation of the laser beam. Moreover, zinc borosilicate may be impregnated into the surface of the core member 11 and, in place of glass material, a resin such as an epoxy resin, may be used as a material for the insulating coating film 3. Furthermore, this insulating coating film 3 is not necessarily required, and without providing an insulating coating film 3 on the surface of a core member 11 a thin-film conductor 12 (to be described later) is directly provided.

Figure 2:
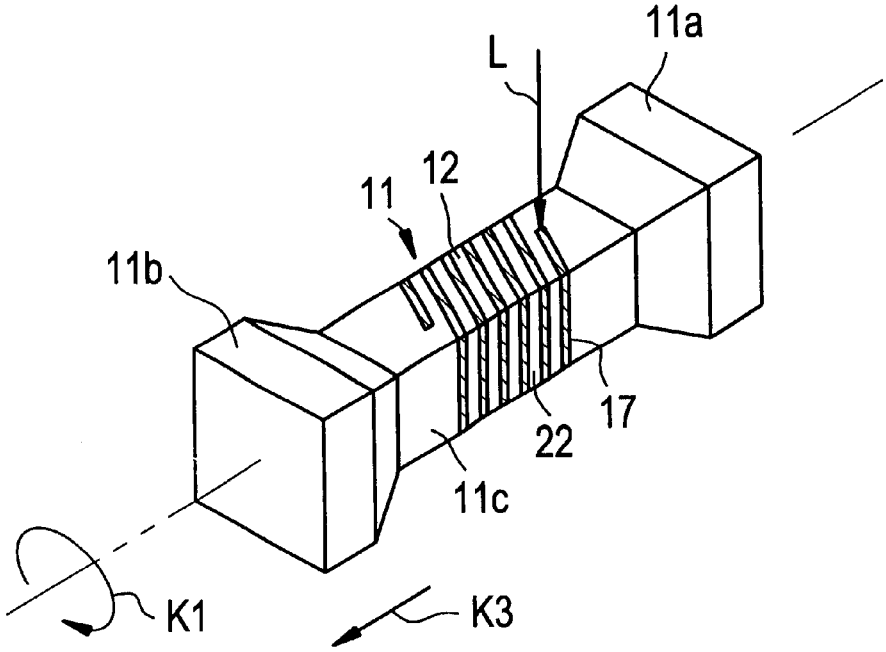
FIG. 2 is a perspective view showing a manufacturing step of the multilayer inductor following the step in FIG. 1.

Next, as shown in FIG. 2, a thin-film conductor 12 is provided on the entire surface of the core member 11 with a method of electroless plating, sputtering, or other suitable method. The thin-film conductor 12 is made of Cu, Ni, Ag, Ag—Pd, or other suitable material. Next, the core member 11 is held, by chucking, in a spindle (not illustrated) of a laser processing apparatus. The core member 11 is rotated in the direction of an arrow K1 (clockwise) by driving the spindle and at the same time moved in parallel in the direction of an arrow K3, and then the coil winding portion 11*c* of the core member 11 is irradiated with a laser beam L. In this way, the thin-film conductor 12 in the area which is irradiated with the laser beam L is removed and a spiral coil-forming groove 17 is formed. Thus, a first thin-film coil 22 spirally surrounding the external surface of the coil winding portion 11*c* is formed.

Figure 3:
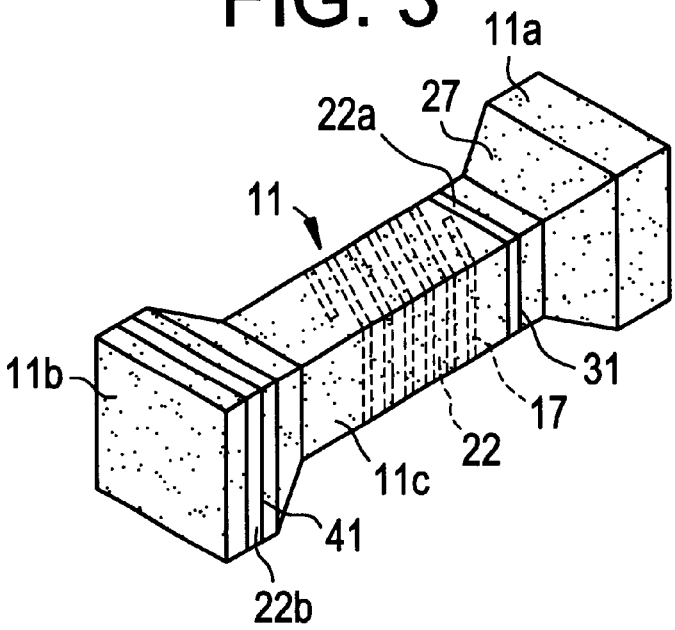
FIG. 3 is a perspective view showing a manufacturing step of the multilayer inductor following the step in FIG. 2.

Next, as shown in FIG. 3, an insulating layer 27 is provided on the thin-film conductor 12 in which the coil-forming groove 17 was formed. The insulating layer 27 is made of an insulating material such as an epoxy resin, or other suitable insulating material. A portion of the insulating layer 27 enters the coil-forming groove 17 and thus the insulation of the thin-film coil 22 is greatly improved.

The insulating layer 27 includes a thin-film coil connecting opening portion 31 located on the side of one end (on the side of the flange portion 11*a*) of the coil winding portion 11*c* of the core member 11 and a lead-out opening portion 41 located on the flange portion 11*b*. These opening portions 31 and 41 surround the core member 11 in the peripheral direction. Then, one connection portion 22*a* of the first thin-film coil 22 is exposed in the opening portion 31 for connecting thin-film coil, and the other connection portion 22*b* of the thin-film coil 22 is exposed in the lead-out opening portion 41. Moreover, the opening portions 31 and 41 may be in the shape of a plurality of straight lines, spots, wavy lines, or other suitable shapes, besides one straight line to ensure an electrical connection.

Figure 4:
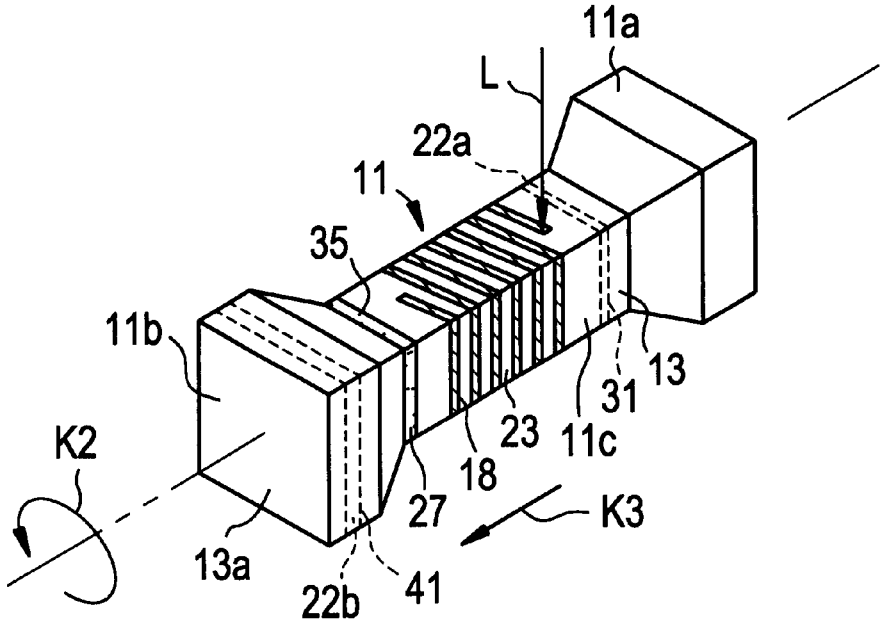
FIG. 4 is a perspective view showing a manufacturing step of the multilayer inductor following the step in FIG. 3.

Next, as shown in FIG. 4, a thin-film conductor 13 is provided on all the surface of the core member 11 by electroless plating, sputtering, or other suitable method. At this time, the thin-film conductor 13 is also filled in the opening portions 31 and 41. In this way, the thin-film conductor 13 is electrically connected to the thin-film conductor 12 and a drive-in-a-wedge effect to increase the physical strength of the thin-film conductor 13 is achieved. Next, the core member 11 is rotated in the direction of an arrow K2 (counterclockwise) and is simultaneously moved in parallel in the direction of the arrow K3, and then the core member 11 is irradiated with a laser beam L. In this way, the thin-film conductor 13 is removed in the portion which is irradiated with a laser beam and a spiral coil-forming groove 18 is produced. Thus, a second thin-film coil 23 spirally surrounding the external surface of the coil winding portion 11*c* in the opposite direction to the winding direction of the first thin-film coil 22 is produced. This second thin-film coil 23 is electrically connected in series to the first thin-film coil 22 through the thin-film coil connecting opening portion 31 provided in the insulating layer 27.

Furthermore, while the core member 11 is rotated, the boundary portion between the flange portion 11*b* and the coil winding portion 11*c* is irradiated with the laser beam L. In this way, a separating groove 35 surrounding the periphery of the core member 11 is provided. This surrounding separating groove 35 enables the second thin-film coil 23 to be electrically connected in series to the first thin-film coil 22. A separated area 13*a* is separated from the thin-film conductor 13 by the surrounding separating groove 35. The second thin-film coil 23 and the separated area 13*a* are electrically disconnected.

Figure 5:
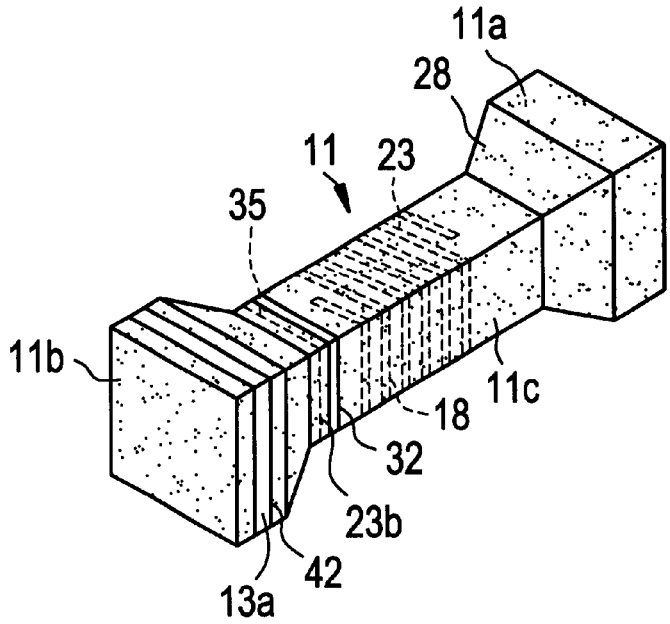
FIG. 5 is a perspective view showing a manufacturing step of the multilayer inductor shown in FIG. 4.

Next, as shown in FIG. 5, an insulating layer 28 is provided on the thin-film conductor 13 having the coil-forming groove 18 provided thereon, in the same way as the insulating layer 27. When the insulating layer 28 is formed, a portion of the layer also enters the coil-forming groove 18 and the surrounding separating groove 35. This insulating layer 28 includes an opening portion 32 for connecting thin-film coil located on the side of the flange portion 11*b* of the coil winding portion 11*c* of the core member 11 and a lead-out opening portion 42 located in the flange portion 11*b*. These opening portions 32 and 42 surround the core member 11 in the direction of its periphery. Then, one connection portion 23*b* of the thin-film coil 23 is exposed in the opening portion 32 for connecting thin-film coil and the separated area 13*a* separated from the thin-film conductor 13 is exposed in the lead-out opening portion 42.

Figure 6:
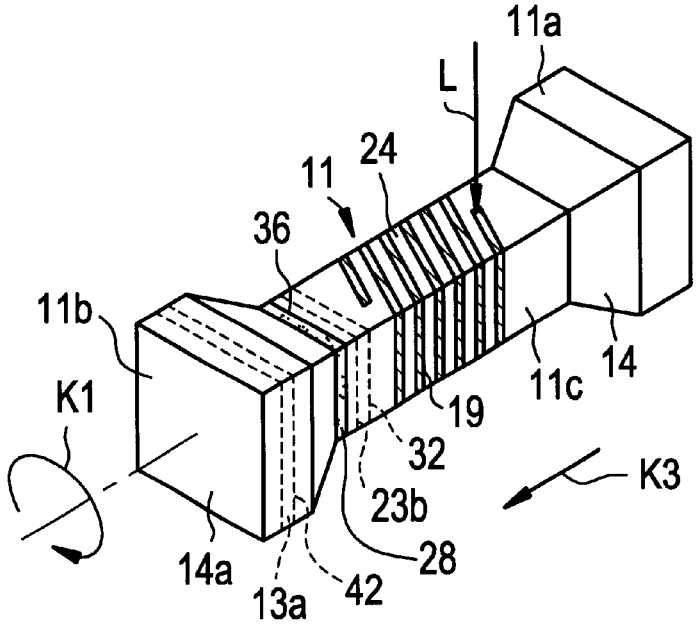
FIG. 6 is a perspective view showing a manufacturing step of the multilayer inductor following the step in FIG. 5.

Next, as shown in FIG. 6, a thin-film conductor 14 is provided on the entire surface of the core member 11 by electroless plating, sputtering, or other suitable method. At this time, the thin-film conductor 14 is filled in the opening portions 32 and 42. Next, while the core member 11 is rotated in the direction of the arrow K1 (clockwise) and at the same time moved in parallel in the direction of the arrow K3, the core member 11 is irradiated with the laser beam. In this way, a spiral coil-forming groove 19 is formed and a third thin-film coil 24 spirally encircling the external surface of the coil winding portion 11*c* in the opposite direction to the encircling direction of the second thin-film coil 23. This third thin-film coil 24 is electrically connected in series to the second thin-film coil 23 through the thin-film coil connecting opening portion 32 formed in the insulating layer 28.

Furthermore, while the core member 11 is rotated, the boundary portion between the flange portion 11*b* and the coil winding portion 11*c* is irradiated with the laser beam L. In this way, a surrounding separating groove 36 surrounding the periphery of the core member 11 is formed. This surrounding separating groove 36 electrically connects the third thin-film coil 24 in series to the second thin-film coil 23. A separated area 14*a* is separated from the thin-film conductor 14 by the surrounding separating groove 36. The thin-film coil 24 and the separated area 14*a* are electrically disconnected. The separated area 14*a* is electrically connected to the separated area 13*a* separated from the thin-film conductor 13 through the lead-out opening portion 42 formed in the insulating layer 28.

Figure 7:
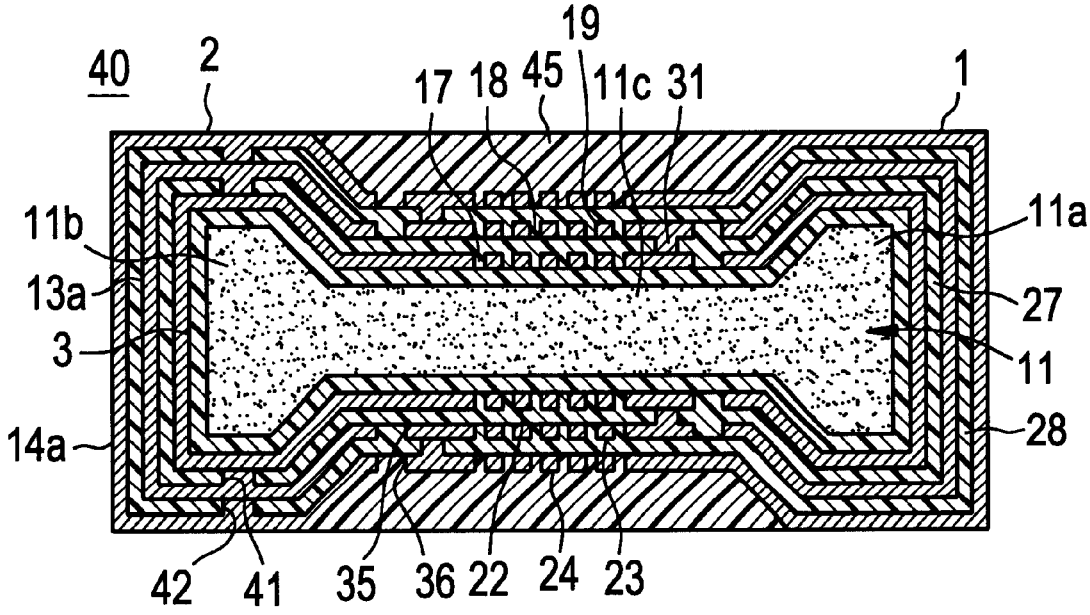
FIG. 7 is a horizontal sectional view of the multilayer inductor shown in FIG. 6.

Then, as shown in FIG. 7, an insulating sheathing portion 45 made of an insulating resin material such as an epoxy resin, or other suitable insulating resin material, is provided excluding the flange portions 11*a* and 11*b* to protect the three thin-film coils 22 23, and 24. Furthermore, the surface of the flange portions 11*a* and 11*b* are coated with Sn plating, Ni—Cu—Sn plating, or other suitable material, to form terminal electrodes 1 and 2 having good soldering characteristics.

Figure 8:
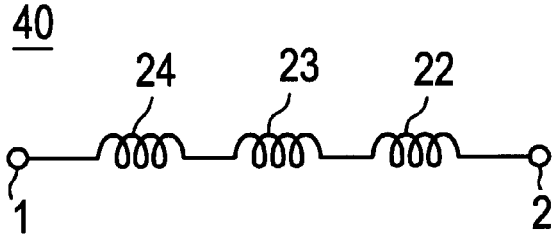
FIG. 8 is an equivalent circuit diagram of the multilayer inductor shown in FIG. 6.
Figure 9A:
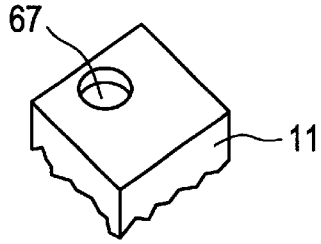
FIGS. 9A to 9D are perspective views showing examples of an identification portion provided on an end face of a core member.
Figure 9B:
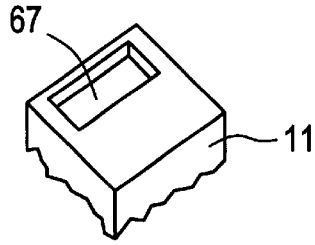
Figure 9C:
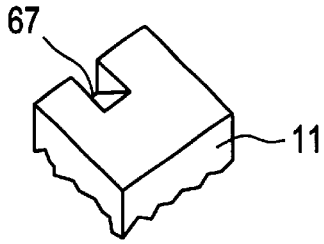
Figure 9D:
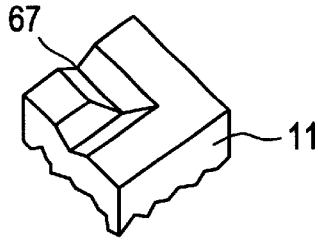
Figure 10A:
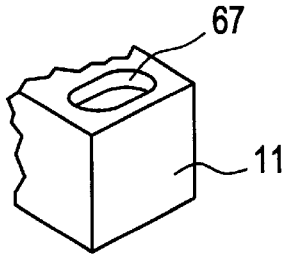
FIGS. 10A to 10D are perspective views showing examples of an identification portion provided on a side face of the core member.
Figure 10B:
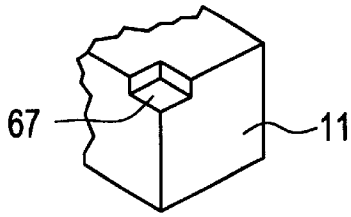
Figure 10C:
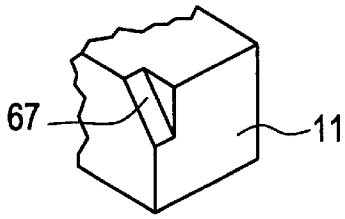
Figure 10D:
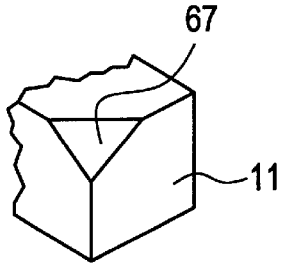

In a multilayer inductor 40 having the above construction, the three thin-film coils 22, 23, and 24 having insulating layers 27 and 28 therebetween are laminated on the coil winding pattern 11*c* of the core member 11. The terminal electrodes 1 and 2 are provided in the flange portions 11*a* and 11*b* of the core member 11, respectively. The terminal electrode 1 is electrically connected to the end portion of the third thin-film coil 24. The terminal electrode 2 is electrically connected to the end portion of the first thin-film coil 22 through the lead-out opening portions 42 and 41 and the separated areas 14a and 13a. In this way, the first thin-film coil 22, the second thin-film coil 23, and the third thin-film coil 24 are electrically connected in series between the terminal electrodes 1 and 2. FIG. 8 is an electric equivalent circuit diagram showing the multilayer inductor 40.

Moreover, to facilitate performing a series of processes of forming the surrounding separating grooves 35 and 36, forming the opening portions 31, 32, 41, and 42, forming the coil-forming grooves 17 to 19, it is desirable to provide concave identification portions 67 in one end face or one side face of the core member 11 in advance as illustrated in FIGS. 9A to 9D or FIGS. 10A to 10D. When an identification portion 67 is provided in an end face of the core member 11, the identification portion 67 is situated towards any one of the four sides and displaced away from the center of the end face. When an identification portion 67 is provided on a side face of the core member 11, the identification portion 67 is disposed in the end portion of one of the side faces. Because of this, the direction of the core member 11 is easily identified and at the same time the four sides of the core member 11 are identified by making use of the identification portion 67. Accordingly, the processing of the surrounding separating grooves 35 and 36 is correctly performed while the direction and side faces of the core member 11 are correctly confirmed on the basis of the identification portion 67. Moreover, the shape of the identification portion 67 is optional and may be protrusive, or any other suitable shape.

In the multilayer inductor 40, as the three thin-film coils 22, 23, and 24 having insulating layers 27 and 28 therebetween are laminated on the coil winding portion 11*c* of the core member 11, the length of the core member 11 is substantially reduced and the number of turns of the thin-film coils 22, 23, and 24 is substantially increased as compared with those which are formed by arranging three thin-film coils side by side in the direction of the axis of a core member.

Furthermore, in the laminated thin-film coils 22, 23, and 24 having the insulating layers 27 and 28 therebetween, the direction of winding of the adjacent thin-film coils is opposite to each other, and accordingly each of the thin-film coils 22 to 24 generates a magnetic field in the same direction. Because of this, a multilayer inductor 40 of reduced size having high inductance is obtained.

Moreover, as the three thin-film coils 22, 23, and 24, having the insulating layers 27 and 28 therebetween, are coaxially disposed on the core member 11, the distributed capacitance between the thin-film coils 22, 23, and 24 is equally generated, and a distributed-constant type multilayer inductor 40 is produced.

In the multilayer inductor 40 of the first preferred embodiment, because the separated area 13*a* and the connection portion 22*b* of the first thin-film coil 22 which are situated below the terminal electrode 2 are electrically connected through the opening portions 41 and 42, even if the separated areas 14*a* and 13*a* are electrically short-circuited by scratches caused by handling of products, bruises from blows, solder, or other causes, or even if the separated area 13*a* and the connection portion 22*b* are electrically short-circuited, the inductor still functions properly. However, the areas of the thin-film conductors 12 and 13 which are situated below the terminal electrode 1 are electrically independent of each other, and accordingly if the thin-film conductors 12 to 14 are electrically short-circuited between them below the terminal electrode 1, a portion of the coils is short-circuited and affects the coil construction.

Then, in the present second preferred embodiment, a multilayer inductor is described in which if layers are short-circuited between them below the terminal electrodes 1 and 2, a portion of the coils is not electrically short-circuited. Moreover, in FIGS. 11 to 16 showing the construction of the second preferred embodiment, the portions corresponding to those in FIGS. 1 to 10 showing the construction of the first preferred embodiment are given the corresponding reference numerals and an overlapping description is omitted.

Figure 11:
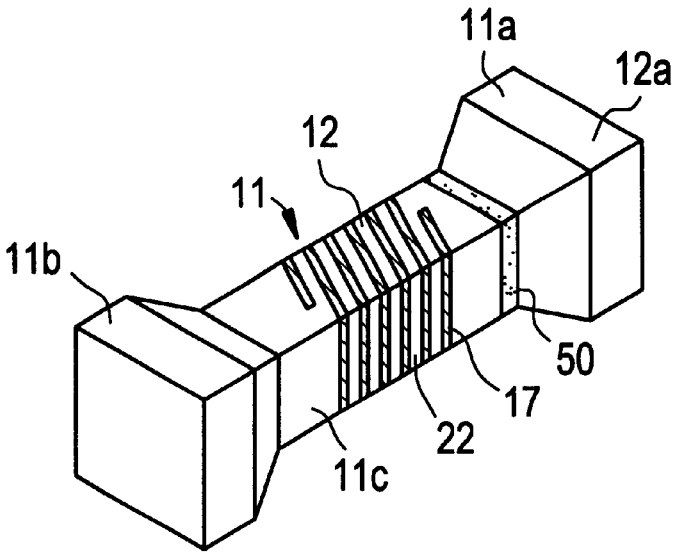
FIG. 11 is a perspective view showing a manufacturing step of a multilayer inductor according to a second preferred embodiment of the present invention.

As is shown in FIG. 11, the thin-film conductor 12 is provided on the entire surface of the core member 11 by a electroless plating, or other suitable method. Next, the coil winding portion 11*c* of the core member 11 is irradiated with the laser beam L. In this way, a spiral coil-forming groove 17 is formed in the thin-film conductor 12 and then the first thin-film coil 22 spirally surrounding the external surface of the coil winding portion 11*c* is formed.

Furthermore, the boundary portion between the flange portion 11*a* and the coil winding portion 11*c* is irradiated with the laser beam L. In this way, a surrounding separating groove 50 surrounding the periphery of the core member 11 is provided. This surrounding separating groove 50 separates a separated area 12*a* from the thin-film conductor 12 to form the separated area 12*a* electrically disconnected from the first thin-film coil 22 below a terminal electrode 1 to be described later.

Figure 12:
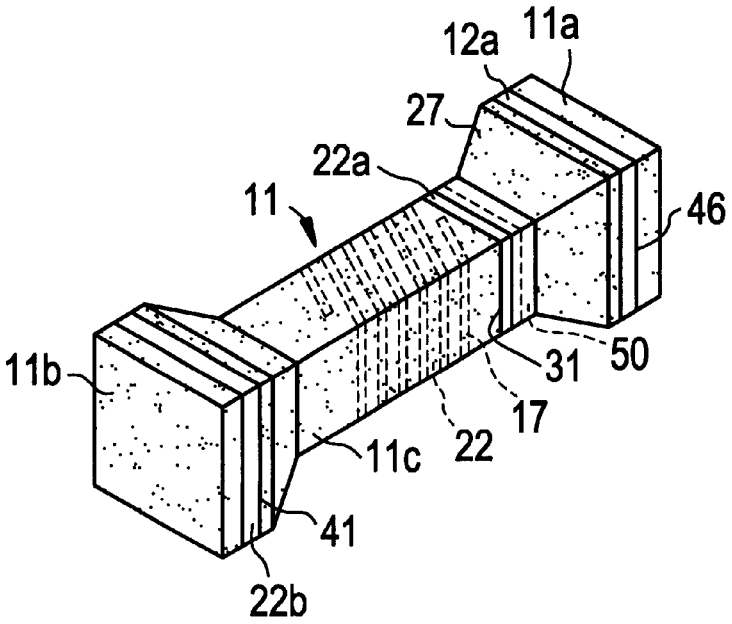
FIG. 12 is a perspective view showing a manufacturing step of the multilayer inductor following the step in FIG. 11.

Next, as shown in FIG. 12, an insulating layer 27 is provided on the thin-film conductor 12 in which the coil-forming groove 17 is formed. This insulating layer 27 contains the opening portion 31 for connecting thin-film coil located on the side of one end (on the side of the flange portion 11*a*) of the coil winding portion 11*c* of the core member 11 and the lead-out opening portions 46 and 41 located in the flange portions 11*a* and 11*b*, respectively. These opening portions surround the core member 11 in the direction of its periphery. Then, one connection portion 22*a* of the first thin-film coil 22 is exposed in the opening portion 31 for connecting thin-film coil, the other connection portion 22*b* of the first thin-film coil 22 is exposed in the lead-out opening portion 41, and the separated area 12*a* is exposed in the lead-out opening portion 46.

Figure 13:
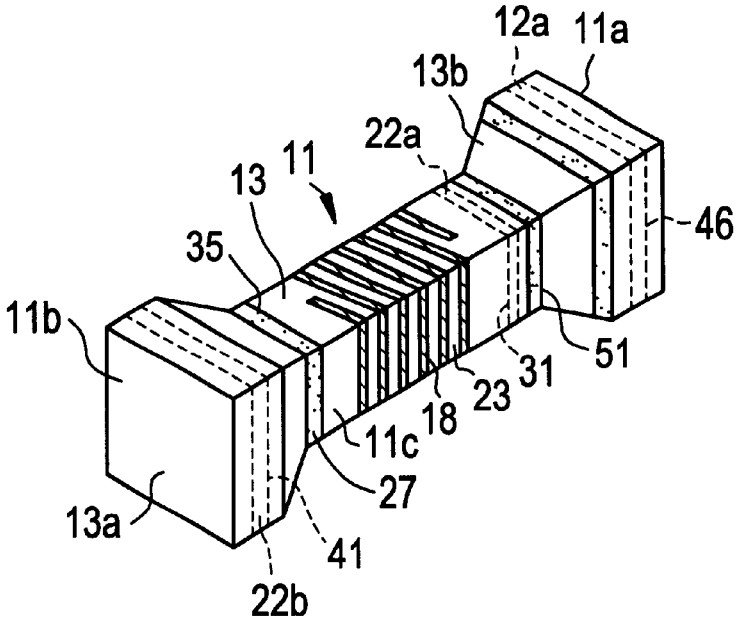
FIG. 13 is a perspective view showing a manufacturing step of the multilayer inductor following the step in FIG. 12.

Next, as shown in FIG. 13, the thin-film conductor 13 is provided on the entire surface of the core member 11 by electroless plating, or other suitable method. At this time, the thin-film conductor 13 is also filled in the opening portions 31, 41, and 46. Next, the spiral coil-forming groove 18 is formed in the thin-film conductor 13 using the laser beam. In this way, the second thin-film coil 23 spirally surrounding the external surface of the coil winding portion 11*c* of the core member 11 in the opposite direction to the winding direction of the first thin-film coil 22. The second thin-film coil 23 is electrically connected in series to the first thin-film coil 22 through the thin-film coil connecting opening portion 31 provided in the insulating layer 27.

Furthermore, each individual boundary portion between the flange portion 11*a* and the coil winding portion 11*c*, and the boundary portion between the flange portion 11*b* and the coil winding portion 11*c* is irradiated with the laser beam L. In this way, the surrounding separating grooves 35 and 51 surrounding the periphery of the core member 11 are formed. Then, the separated areas 13*a* and 13*b* are separated from the thin-film conductor 13 by the surrounding separating grooves 35 and 51 and the second thin-film coil 23, and the separated areas 13*a* and 13*b* are electrically disconnected. The surrounding separating groove 35 electrically connects the second thin-film coil 23 to the first thin-film coil.22. The surrounding separating groove 51 defines the separated area 13*b* electrically disconnected from the second thin-film coil 23 below the terminal electrode 1. The separated area 13*a* is electrically connected to the connection portion 22*b* of the first thin-film coil 22 through the lead-out opening portion 41 provided in the insulating layer 27. The separated area 13*b* is electrically connected to the separated area 12*a* through the lead-out opening portion 46 formed in the insulating layer 27.

Figure 14:
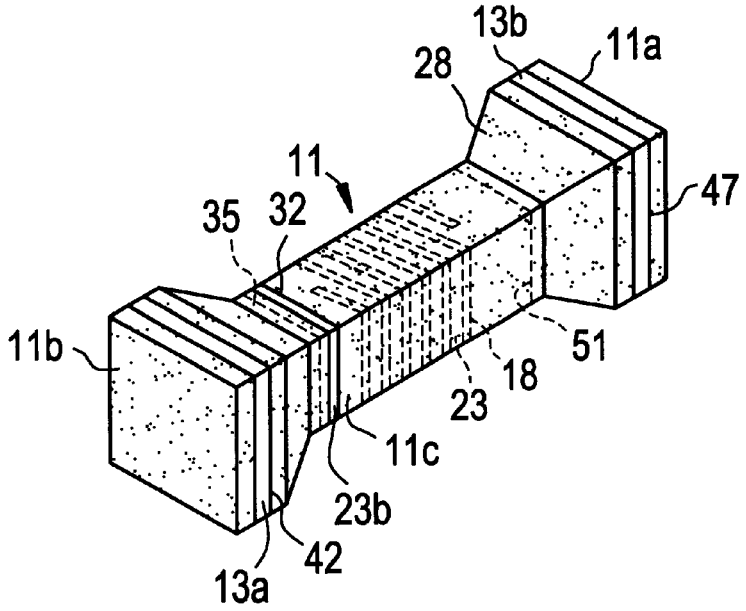
FIG. 14 is a perspective view showing a manufacturing step of the multilayer inductor following the step in FIG. 13.

Next, as shown in FIG. 14, an insulating layer 28 is provided on the thin-film conductor 13 having the coil-forming groove 18 formed therein. This insulating layer 28 includes the opening portion 32 for connecting thin-film coil located on the side of the flange portion 11*b* of the coil winding portion 11*c* of the core member 11, and the lead-out opening portions 47 and 42 located in the flange portions 11*a* and 11*b*, respectively. These opening portions 32, 42, and 47 surround the core member 11 in its peripheral direction. Then, one connection portion 23*b* of the second thin-film coil 23 is exposed in the thin-film coil connecting opening portion 32, the separated area 13*a* is exposed in the lead-out opening portion 42, and the separated area 13*b* is exposed in the lead-out opening portion 47.

Figure 15:
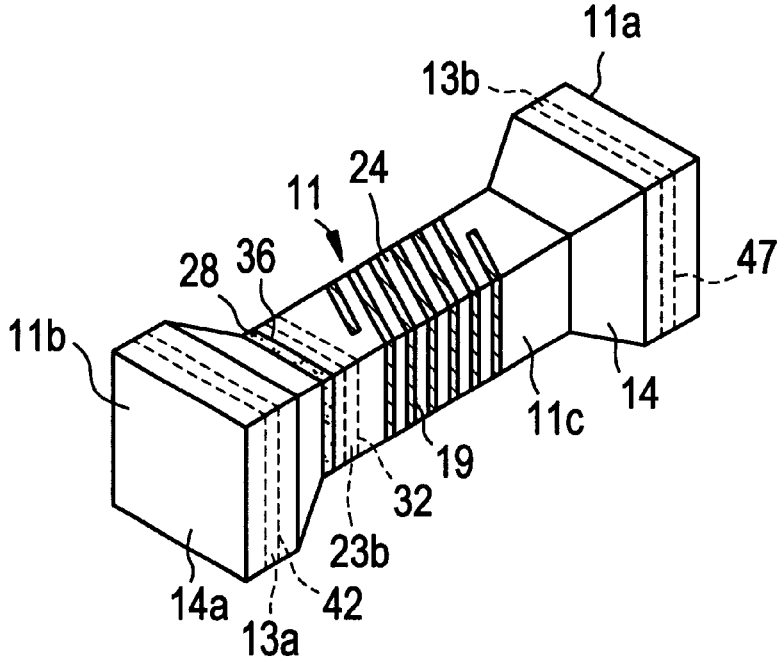
FIG. 15 is a perspective view show a manufacturing step of the multilayer inductor following the step in FIG. 14.

Next, as shown in FIG. 15, a thin-film conductor 14 is provided on the entire surface of the core member 11 by electroless plating, or other suitable method. Then, the thin-film conductor 14 is also filled in the opening portions 32, 42, and 47. Next, a spiral coil-forming groove 19 is formed in the thin-film conductor 14 by using the laser beam L. Thus, the third thin-film coil 24 is formed in the opposite direction to the winding direction of the second thin-film coil 23. The third thin-film coil 24 is electrically connected in series to the second thin-film coil 23 via the thin-film coil connecting opening portion 32 formed in the insulating layer 28.

Furthermore, the boundary portion between the flange portion 11*b* and the coil winding portion 11*c* is irradiated with the laser beam L to form a surrounding separating groove 36 surrounding the periphery of the core member 11. The surrounding separating groove 36 electrically connects the third thin-film coil 24 in series to the second thin-film coil 23. The separated area 14*a* is separated from the thin-film conductor 14 by the surrounding separating groove 36 and, then the third thin-film coil 24 and the separated area 14*a* are electrically disconnected. The separated area 14*a* is electrically connected to the separated area 13*a* separated from the thin-film conductor 13 through the lead-out opening portion 42 provided in the insulating layer 28. The connection portion, on the side of the flange portion 11*a*, of the third thin-film coil 24 is electrically connected to the separated area 13*b* through the lead-out opening portion 47 provided in the insulating layer 28.

Figure 16:
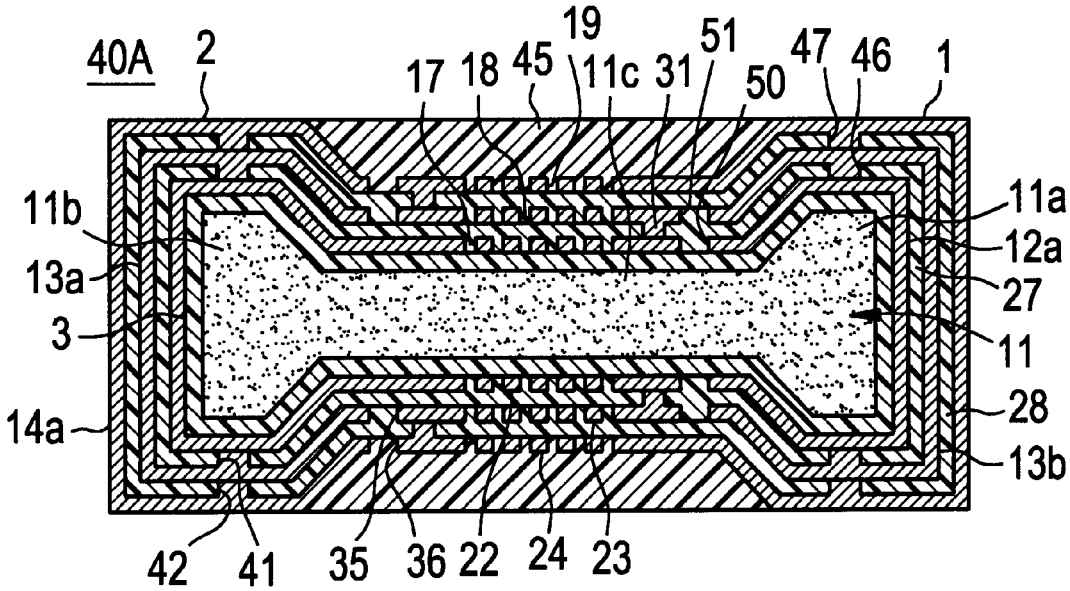
FIG. 16 is a horizontal sectional view of the multilayer inductor shown in FIG. 15.

Then, as shown in FIG. 16, an insulating sheathing portion 45 is provided, except for on the flange portions 11*a* and 11*b*, to protect the thin-film coils 22, 23, and 24. Furthermore, the surfaces of the flange portions 11*a* and 11*b* are coated with Sn plating, or other suitable coating, to define the terminal electrodes 1 and 2.

In a multilayer inductor 40A constructed as described above, in addition to the operation of the multilayer inductor of the first preferred embodiment, because the separated areas 12*a* and 13*b* located below the terminal electrode 1 are electrically disconnected from the thin-film coils 22 and 23 and electrically connected to the terminal electrode 1 through the opening portions 46 and 47, even if the terminal electrode 1 and the separated areas 12*a* and 13*b* are electrically short-circuited because of scratches at handling of products, bruises from blows, solder, or other causes, a portion of the coils is not electrically short-circuited and the circuit constants are not changed.

A third preferred embodiment is another embodiment of the multilayer inductor in which, even if the layers are short-circuited from below the terminal electrodes 1 and 2, a portion of the coils is not electrically short-circuited. Moreover, in FIGS. 17 to 22 showing the construction of the third preferred embodiment, the portions corresponding to those in FIGS. 1 to 10 showing the construction of the first preferred embodiment are given the corresponding reference numerals and an overlapping description is omitted.

Figure 17:
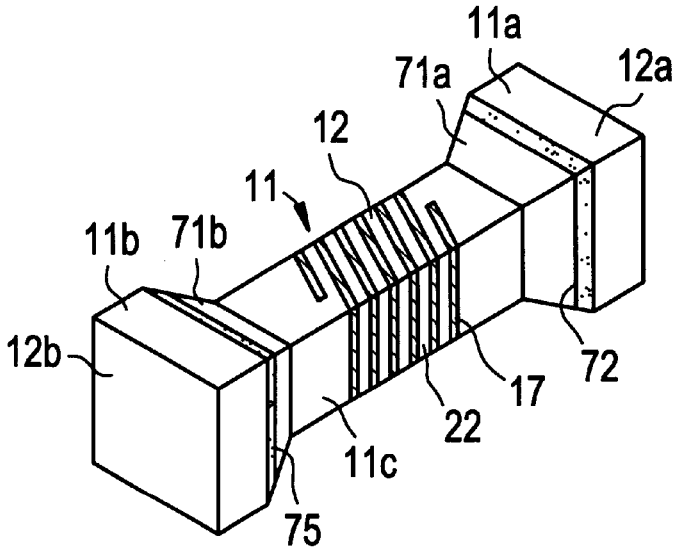
FIG. 17 is a perspective view showing a manufacturing step of a multilayer inductor according to a third preferred embodiment of the present invention.

As shown in FIG. 17, the thin-film conductor 12 is provided on the entire surface of the core member 11 by electroless plating, or other suitable method. Next, the coil winding portion 11*c* of the core member 11 is irradiated with the laser beam L. Thus, a spiral coil-forming groove 17 is formed in the thin-film conductor 12 and then the first thin-film coil 22 spirally surrounding the external surface of the coil winding portion 11*c* is formed.

Furthermore, a portion of the inclined portion 71*a* on the side of the flange portion 11*a* and a portion of the inclined portion 71*b* on the side of the flange portion 11*b* are irradiated with the laser beam 1. In this way, the surrounding separating grooves 72 and 75 surrounding the periphery of the core member 11 are produced. The surrounding separating groove 72 separates the separated area 12*a* from the thin-film conductor 12 and forms the separated area 12*a* electrically disconnected from the first thin-film coil 22 below the terminal electrode 1 (to be described later). In the same way, the surrounding separating groove 75 separates a separated area 12*b* from the thin-film conductor 12 and forms the separated area 12b, located below a terminal electrode 2 (to be described later), electrically disconnected from the first thin-film coil 22.

Figure 18:
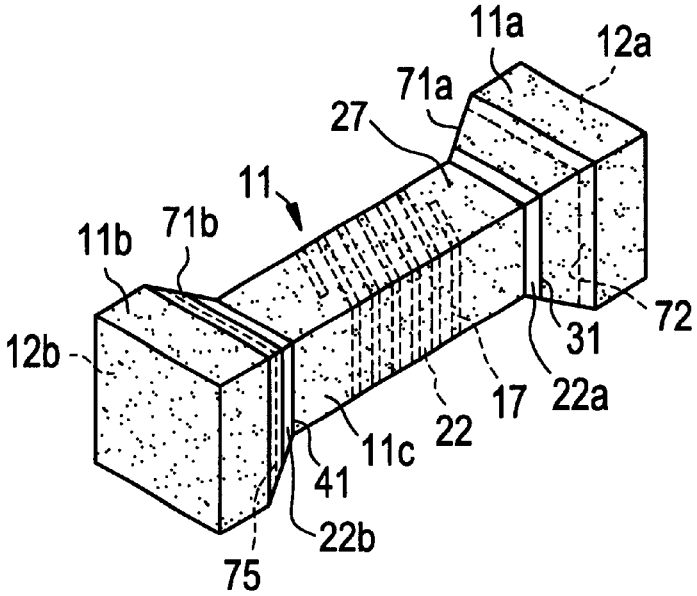
FIG. 18 is a perspective view showing a manufacturing step of the multilayer inductor following the step in FIG. 17.

Next, as shown in FIG. 18, an insulating layer 27 is provided on the thin-film conductor 12 having the coil-forming groove 17 formed therein. The insulating layer 27 includes a thin-film coil connecting opening portion 31 on the side of the coil winding portion 11*c* of the inclined portion 71*a* and a lead-out opening portion 41 on the side of the coil winding portion 11*c* of the inclined portion 71*b*. These opening portions 31 and 41 surround the core member 11 in its peripheral direction. Then, one connection portion 22*a* of the first thin-film coil 22 is exposed in the thin-film coil connection opening portion 31 and the other connection portion 22*b* of the first thin-film coil 22 is exposed in the lead-out opening portion 41.

Figure 19:
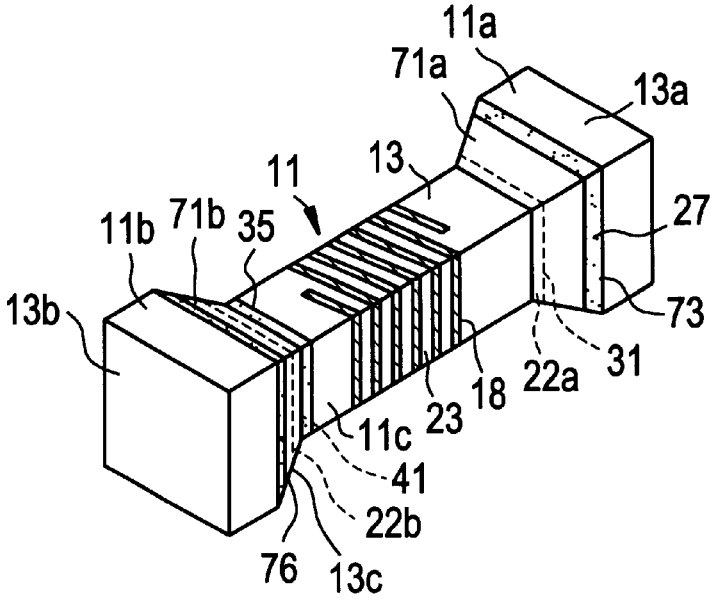
FIG. 19 is a perspective view showing a manufacturing step of the multilayer inductor following the step in FIG. 18.

Next, as shown in FIG. 19, a thin-film conductor 13 is provided on the entire surface of the core member 11 by electroless plating, or other suitable method. At this time, the thin-film conductor 13 is also filled in the opening portions 31 and 41. Next, a spiral coil-forming groove 18 is formed in the thin-film conductor 13 by using the laser beam L. Thus, the second thin-film coil 23 spirally surrounding the external surface of the coil winding portion 11*c* of the core member 11 is formed in the opposite direction to the winding direction of the first thin-film coil 22. This second thin-film coil 23 is electrically connected in series to the first thin-film coil 22 through the thin-film coil connecting opening portion 31 provided in the insulating layer 27.

Furthermore, each of a portion on the side of the flange portion 11*b*, of the coil winding portion 11*c*; a portion on the side of the flange portion 11*a*, of the inclined portion 71*a*; and a portion on the side of the flange portion 11*b*, of the inclined portion 71*b* is irradiated with the laser beam L. In this way, surrounding separating grooves 35, 73, and 76 surrounding the core member 11 are provided. The surrounding separating groove 35 is electrically connected to the second thin-film coil 23 in series to the first thin-film coil 22. The surrounding separating groove 73 forms a separated area 13*a* electrically disconnected from the second thin-film coil 23, located below the terminal electrode 1. The surrounding separating groove 76 forms a separated area 13*b* electrically disconnected from the second thin-film coil 23, located below the terminal electrode 2.

Moreover, a separated area 13*c* formed between the surrounding separating grooves 35 and 76 is electrically connected to the connection portion 22*b* of the first thin-film coil 22 through the lead-out opening portion 41 formed in the insulating layer 27.

Figure 20:
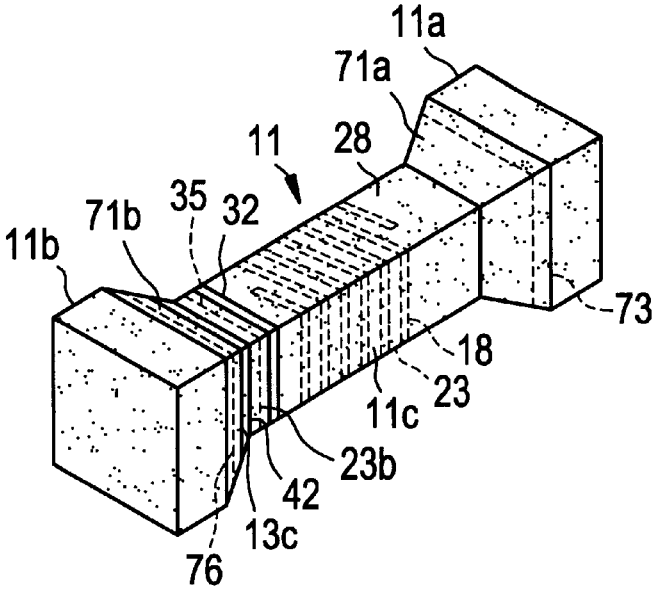
FIG. 20 is a perspective view showing a manufacturing step of the multilayer inductor following the step in FIG. 19.

Next, as shown in FIG. 20, an insulating layer 28 is formed on the thin-film conductor 13 having the coil-forming groove 18 formed therein. The insulating layer 28 includes the opening portion 32 for connecting thin-film coil, located close to the flange portion 11*b*, in the coil winding portion 11*c* and a lead-out opening portion 42, located close to the coil winding portion 11*c*, in the inclined portion 71*b*. These opening portions 32 and 42 surround the core member 11 in its peripheral direction. Then, one connection portion 23*b* of the second thin-film coil 23 is exposed in the thin-film coil connecting opening portion 32 and the separated area 13*c* is exposed in the lead-out opening portion 42.

Figure 21:
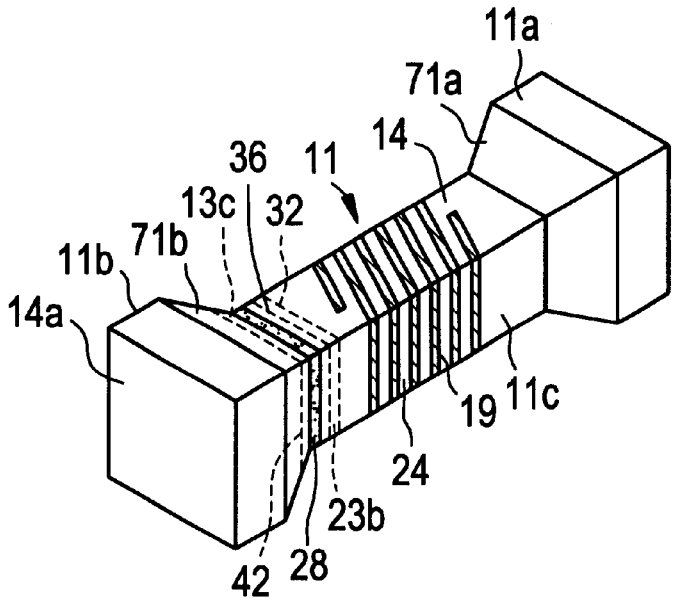
FIG. 21 is a perspective view showing a manufacturing step of the multilayer inductor following the step in FIG. 20.

Next, as shown in FIG. 21, a thin-film conductor 14 is provided on the entire surface of the core member 11 by electroless plating, or other suitable method. At this time, the thin-film conductor 14 is also filled in the opening portions 32 and 42. Next, a spiral coil-forming groove 19 is formed in the thin-film conductor 14 by using the laser beam L. Thus, the third thin-film coil 24 is formed in a spirally surrounding direction which is opposite to the surrounding direction of the second thin-film coil 23. The third thin-film coil 24 is electrically connected in series to the second thin-film coil 23 through the thin-film coil connecting opening portion 32 formed in the insulating layer 28.

Furthermore, the coil winding portion 11*c* on the side of the flange portion 11*b* is irradiated with the laser beam 1 to form a surrounding separating groove 36 surrounding the periphery of the core member 11. This surrounding separating groove 36 electrically connects the third thin-film coil 24 in series to the second thin-film coil 23. A separated area 14*a* is separated from the thin-film conductor 14 by the surrounding separating groove 36 and then the third thin-film coil 24 and the separated area 14*a* are electrically disconnected from each other. The separated area 14*a* is electrically connected to the separated area 13*c* through the lead-out opening portion 42 provided in the insulating layer 28.

Figure 22:
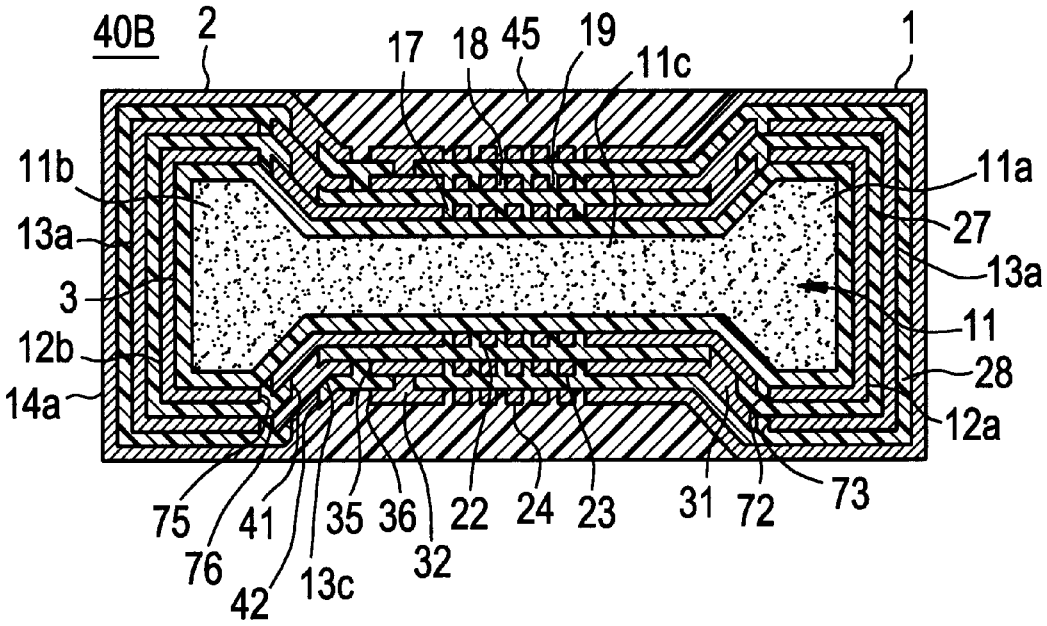
FIG. 22 is a horizontal sectional view of the multilayer inductor shown in FIG. 20.

Then, as shown in FIG. 22, an insulating sheathing 45 is provided, leaving the flange portions 11*a* and 11*b*, to protect the thin-film coils 22, 23, and 24. Furthermore, the surfaces of the flange portions 11*a* and 11*b* are coated with Sn plating, or other suitable coating, to define the terminal electrodes 1 and 2.

In a multilayer inductor 40B constructed as described above, the terminal electrode 1 is electrically connected to the end portion of the third thin-film coil 24. The terminal electrode 2 is electrically connected to the end portion of the first thin-film coil 22 through the lead-out opening portions 42 and 41 and the separated areas 14*a* and 13*c*. Thus, the thin-film coils 22, 23, and 24 are electrically connected in series between the terminal electrodes 1 and 2.

In the multilayer inductor 40B, in addition to the operation of the multilayer inductor 40 of the first preferred embodiment, because the separated areas 12*a* and 13*a* located below the terminal electrode 1 and the separated areas 12*b* and 13*b* located below the terminal electrode 2 are electrically disconnected from the other conductors, even if the terminal electrode 1 and the separated areas 12*a* and 13*a* or the terminal electrode 2 and the separated areas 12*b* and 13*b* are electrically short-circuited, a portion of the coils are not short-circuited.

Moreover, the present invention is not limited to the above-described preferred embodiments and can be altered without departing the spirit and scope of the invention. For example, a columnar or cylindrical core member having a circular, triangular, pentagonal, or polygonal section (having more than five sides and angles) can be used instead of a dumbbell-shaped one. Furthermore, when a coil is composed of thin-film coils of an even number which are electrically connected in series, the beginning and the end of the coil are disposed on the side of the same terminal electrode and accordingly the beginning and the end of the coil may be made to be connected to different terminal electrodes, respectively, by providing one more thin-film conductor layer for return.

Furthermore, the separating grooves and coil-forming grooves may be processed by computer-controlled operation. Moreover, a dielectric layer is provided to cover a thin-film coil and the electrodes as capacitors are provided on the dielectric layer, and in this way a capacitor-embedded inductor may be produced. Other inductors containing electronic devices, such as resistors, therein may be formed.

Furthermore, when the separating grooves and coil-forming grooves are formed, although the laser beam is used in the above preferred embodiments, an electron beam, an ion beam, or other suitable device, may also be used, and they may be formed by a method of sand blasting, cutting using a diamond saw, or other suitable method. Moreover, in the above preferred embodiments, after the thin-film conductor has been provided on the entire surface of the core member, a method of forming the thin-film coil by removing unnecessary portions of the thin-film conductor as in the separating grooves and coil-forming grooves is used, but this is not limited, and a method of forming the thin-film coil by supplying the conductor only to a necessary portion through sputtering, evaporation, plating, or other suitable method, which is known as an additive process may be adopted.

As is clearly understood in the above description, according to the present invention, a plurality of thin-film coils having insulating layers therebetween are laminated and the winding directions of the adjacent thin-film coils having an insulating layer therebetween are opposite to each other, and accordingly each of the thin-film coils generates a magnetic field in the same direction. Therefore, an inductor having a greatly reduced size and a greatly increased inductance is obtained. Furthermore, as two thin-film coils having an insulating layer therebetween are disposed on the core member to have a common axis, distributed capacitance is equally generated and a distributed constant type multilayer inductor is obtained.

Furthermore, the second separating portions surrounding the periphery of the core member are provided between an area where the thin-film coils are provided and areas where the terminal electrodes are provided such that the separated areas, electrically disconnected from the thin-film coils, are formed below the terminal electrodes, and accordingly even if the layers are short-circuited below the terminal electrodes, part of the coils are not electrically short-circuited and circuit constants are not altered or adversely affected.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A multilayer inductor comprising:

a core member;

a plurality of thin-film coils laminated on the surface of the core member and having a spirally wound arrangement, each of said plurality of thin film coils being defined by a layer;

insulating layers provided between each of said plurality of thin-film coils; and terminal electrodes provided at end portions of the core member; wherein the winding directions of the adjacent thin-film coils having said insulating layers therebetween are opposite to each other;

the plurality of the thin-film coils are electrically connected in series; and at least one of the layers defining said plurality of thin-film coils includes a separated area which is separated from the respective thin-film coil by a separating groove.

2. A multilayer inductor as claimed in claim 1, further comprising first separating portions for electrically connecting the thin-film coils in series, said first separating portions arranged between an area where the thin-film coils are provided and the areas where the terminal electrodes are provided to surround the periphery of the core member, wherein the adjacent thin-film coils having the insulating layers therebetween are electrically connected in series through an opening portion in the insulating layers for connecting the thin-film coils provided.

3. A multilayer inductor as claimed in claim 2, wherein at least one of the beginning and the end of a coil including the plurality of thin-film coils electrically connected in series is electrically connected to the terminal electrode through lead-out opening portions provided in the insulating layers.

4. A multilayer inductor as claimed in claim 2, further comprising second separating portions to form separated areas electrically disconnected from the thin-film coils below the terminal electrodes, said second separating portions arranged between the area where the thin-film coils are provided and the areas where the terminal electrodes are provided to surround the periphery of the core member.

5. A multilayer inductor as claimed in claim 4, wherein at least one of the beginning and the end of a coil including the plurality of thin-film coils electrically connected in series is electrically connected to the terminal electrode through lead-out opening portions provided in the insulating layers.

6. A multilayer inductor as claimed in claim 1, wherein the core member is dumbbell-shaped.

7. A multilayer inductor as claimed in claim 1, wherein an identification portion for identifying the direction of the core member is provided on at least one of an end face and a side face of the core member.

8. A multilayer inductor as claimed in claim 1, wherein said plurality of thin-film coils includes three thin-film coils.

9. A multilayer inductor as claimed in claim 3, wherein said lead-out opening portions provided in the insulating layers are defined by single straight lines.

10. A multilayer inductor as claimed in claim 1, wherein said core is made of Ni—Zn—Cu ferrite.

* * * * *